US005974845A

United States Patent [19]

Wang et al.

[11] Patent Number: 5,974,845

[45] Date of Patent: Nov. 2, 1999

[54] KEY RING

[75] Inventors: Robert Wang, Taipei; Jack Wang, Taichung Hsien, both of Taiwan

[73] Assignee: Ceramate Technical Co., Ltd., Tao-Yuan Hsien, Taiwan

[21] Appl. No.: 09/245,014

[22] Filed: Feb. 4, 1999

[51] Int. Cl.[6] ..... A47G 29/10

[52] U.S. Cl. ..... 70/456 R; 70/459

[58] Field of Search ..... 70/456 R–459; 24/3 R; D3/207–212

[56] References Cited

U.S. PATENT DOCUMENTS

| | | | |
|---|---|---|---|
| 3,813,907 | 6/1974 | Jones, Jr. et al. | 70/456 R |
| 3,908,418 | 9/1975 | Stoffel | 70/456 R |
| 3,968,670 | 7/1976 | Quenot | 70/456 R |
| 4,259,857 | 4/1981 | Fontana | 70/456 B |
| 4,516,776 | 5/1985 | Nicholas | 70/459 X |
| 5,363,680 | 11/1994 | Wu | 70/456 B |
| 5,787,745 | 8/1998 | Chang | 70/456 R |

FOREIGN PATENT DOCUMENTS

| | | | |
|---|---|---|---|
| 1043749 | 12/1978 | Canada | 70/456 R |
| 776552 | 1/1935 | France | 70/456 R |
| 2613192 | 10/1988 | France | 70/456 R |
| 3926410 | 2/1991 | Germany | 70/456 R |

*Primary Examiner*—Suzanne Dino Barrett

[57] ABSTRACT

A key ring includes a casing with complementary casing walls. The casing walls have stem halves which project from surrounding wall portions thereof and which have semi-circular outer threaded surfaces that mate with each other so as to form a tubular stem with a spirally winding continuous threaded line thereon surrounding an axis. A nut member has an internal threaded surface at a proximate end portion thereof to screw on the tubular stem so as to clamp the stem halves together, and a retaining protrusion at a distal end portion thereof. A cap member has an enlarged head portion, and an engaging end portion with an elongated guiding groove to receive and guide the retaining protrusion when the engaging end portion is inserted into the nut member. A retaining recess is formed between the enlarged head portion and the engaging end portion, and extends angularly about the axis. Thus, once the retaining protrusion is brought to move along the guiding groove to slip into the retaining recess, the retaining protrusion can be rotated relative to the cap member about the axis so as to be retained in the retaining recess. A ring member is secured to the casing and is used to fasten keys thereon.

5 Claims, 4 Drawing Sheets

KEY RING

BACKGROUND OF THE INVENTION

1. Field of the Invention

This invention relates to a key ring, more particularly to a key ring with a detachable casing for easily varying a decorating member received therein.

2. Description of the Related Art

A conventional key ring generally has a stationary body and a ring member secured on the body for fastening keys thereon. However, the conventional key ring is monotonous and does not provide any variety in its outer appearance.

SUMMARY OF THE INVENTION

The object of the present invention is to provide a key ring with a casing which includes complementary right and left casing walls that are easily separated from each other so as to displace a decorating member received therebetween for varying the outer appearance of the key ring.

According to this invention, the key ring includes a casing which has complementary right and left casing walls. Each of the right and left casing walls has a major wall portion, a surrounding wall portion which extends transverse to and from the major wall portion, and a stem half which projects from the surrounding wall portion and which has a semi-circular outer threaded surface. The semi-circular outer threaded surfaces mate with each other to form a tubular stem with a spirally winding continuous threaded line thereon surrounding an axis. A nut member has an inner peripheral wall with an internal threaded surface at a proximate end thereof to screw on the tubular stem so as to clamp the right and left stem halves together, and a retaining protrusion at a distal end thereof. A cap member has an enlarged head portion, and an engaging end portion with an annular surrounding wall having an elongated guiding groove that extends along the axis so as to receive and guide the retaining protrusion when the engaging end portion is brought to be inserted into the nut member. A retaining recess is formed in the annular surrounding wall between the enlarged head portion and the engaging end portion, and extends angularly about the axis. Thus, once the retaining protrusion is brought to move along the guiding groove to slip into the retaining recess, the retaining protrusion will be able to rotate relative to the cap member about the axis so as to be retained in the retaining recess. A ring member is secured to the casing for fastening keys thereon.

BRIEF DESCRIPTION OF THE DRAWINGS

Other features and advantages of the present invention will become apparent in the following detailed description of the preferred embodiment of the invention, with reference to the accompanying drawings, in which.

DETAILED DESCRIPTION OF THE PREFERRED EMBODIMENT

Figure 1:
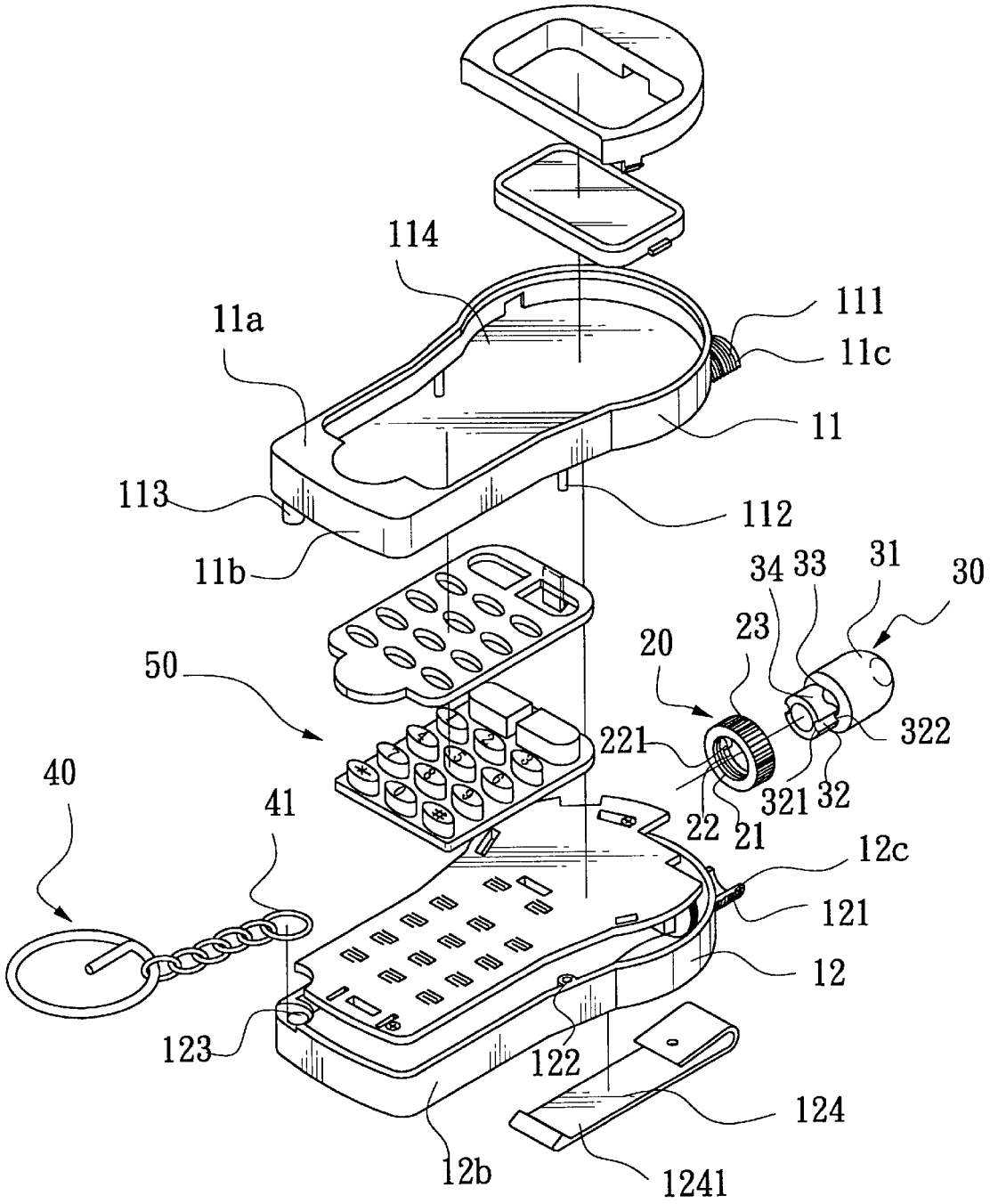
FIG. 1 is an exploded view of a preferred embodiment of a key ring according to this invention.
Figure 2:
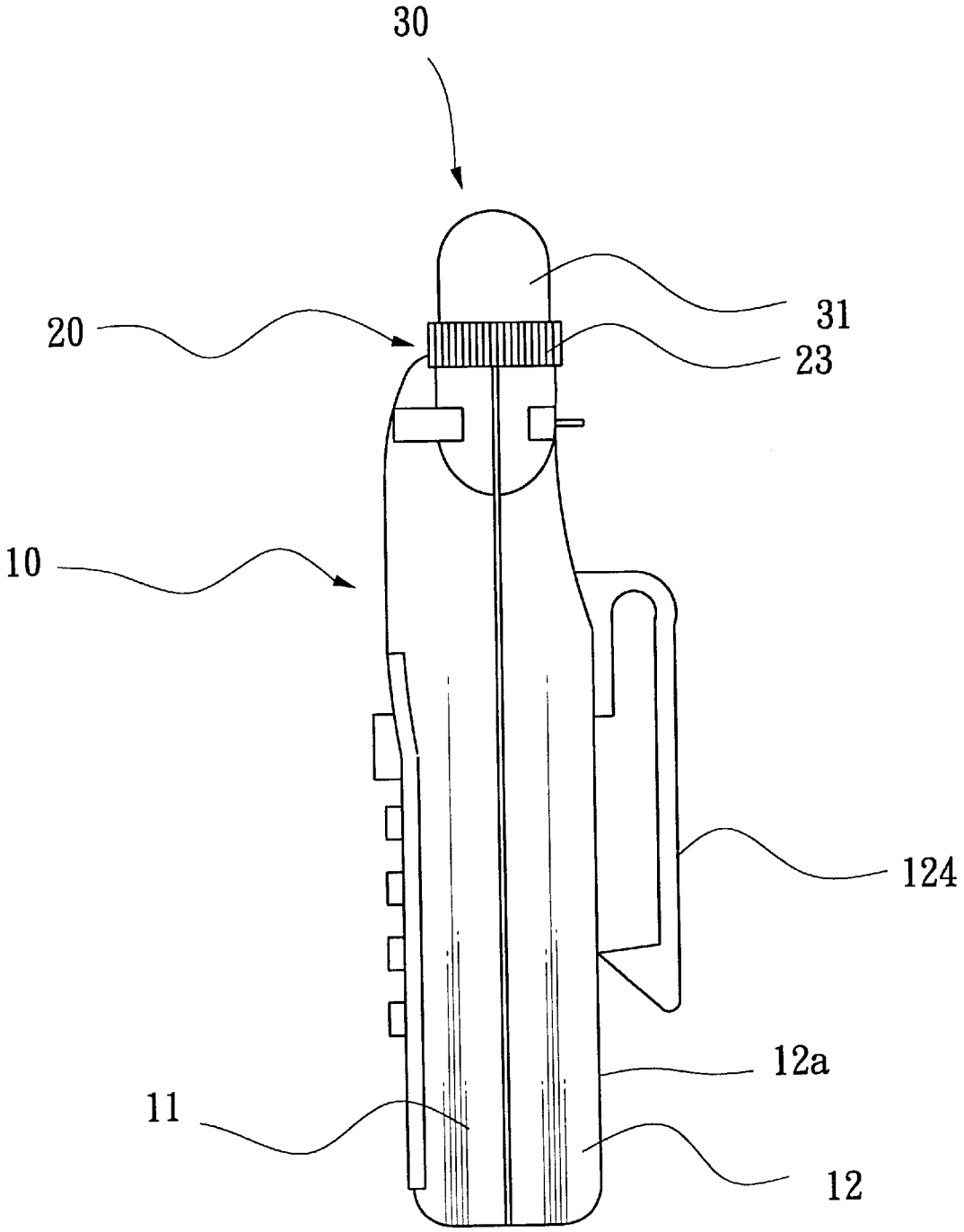
FIG. 2 is a side view of the preferred embodiment.

Referring to FIGS. 1 and 2, the preferred embodiment of the key ring according to the present invention is shown to comprise a casing 10, a nut member 20, a cap member 30, and a ring member 40.

The casing 10 includes complementary right and left casing walls 12, 11. The right casing wall 12 has a right major wall portion 12*a* which extends in a first direction, a right surrounding wall portion 12*b* which extends from a periphery of the right major wall portion 12*a* in a second direction transverse to the first direction, and a right stem half 12*c* which protrudes from the right surrounding wall portion 12*b* in the first direction and which has a semi-circular right outer threaded surface 121 thereon. A plurality of socket joining members 122 and an insert hole 123 are disposed on the right surrounding wall portion 12*b*. A hanger 124 is mounted on the right major wall portion 12*a*, and has a finger portion 1241 which extends parallel to and spaced apart from the right major wall portion 12*a* for hooking on a support.

The left casing wall 11 has a left major wall portion 11*a* which extends in the first direction, and a left surrounding wall portion 11*b* which extends from a periphery of the left major wall portion 11*a* opposite to the second direction and which complementarily mates with the right surrounding wall portion 12*b* so as to define a receiving chamber between the right and left casing walls 12,11. A left stem half 11*c* protrudes from the left surrounding wall portion 11*b* in the first direction, and has a semi-circular left outer threaded surface 111 thereon so as to cooperate with the right outer threaded surface 121 to form a tubular stem with a spirally winding continuous threaded line thereon that surrounds an axis parallel to the first direction when the left casing wall 11 is brought along the second direction to mate with the right casing wall 12. In addition, a plurality of plug joining members 112 and an engaging plug 113 are disposed on the left surrounding wall portion 11*b* for engaging the socket joining members 122 and the insert hole 123, thereby strengthening the connection of the left casing wall 11 with the right casing wall 12. In addition, the left major wall portion 11*a* has an opening 114 formed therein.

The nut member 20 has an inner peripheral wall with a proximate end portion 21 and a distal end portion 22 opposite to the proximate end portion 21 in the first direction. The proximate end portion 21 has an internal threaded surface to screw on and engage the tubular stem so as to clamp the right and left stem halves 12*c*, 11*c* together, thereby joining the left casing wall 11 with the right casing wall 12. The distal end portion 22 has two retaining protrusions 221 which project inwardly and radially from the inner peripheral wall. The nut member 20 further has a surrounding wall with serrations 23 to facilitate gripping of the same by the fingers of the user.

The cap member 30 has an enlarged head portion 31, and an engaging end portion 34 with an annular surrounding wall which has two elongated guiding grooves 32 formed inwardly and radially of the surrounding wall. Each guiding groove 32 of the nut member 20 extends along the axis, and has a lead end 321 distal to the enlarged head portion 31 and a tail end 322 proximate to the enlarged head portion 31 so as to receive and guide a respective one of the retaining protrusions 221 when the engaging end portion 34 is brought to be inserted into the distal end portion 22 along the first direction from the lead ends 321. The annular surrounding wall further has two retaining recesses 33 which are formed therein. Each retaining recess 33 is disposed between the enlarged head portion 31 and the engaging end portion 34, and extends angularly about the axis. As such, once each retaining protrusion 221 is brought to move along the respective guiding groove 32 and beyond the tail end 322 to slip into the respective retaining recess 33, the retaining protrusions 221 will be able to rotate relative to the cap member 30 about the axis so as to be retained in the retaining recesses 33, respectively.

The ring member 40 has a ring end 41 that permit passage of the engaging plug 113 therethrough for securing the same on the casing 10 and that is adapted for fastening keys thereon.

A decorating member 50 with a mobile phone-like shape, is received in the receiving chamber of the casing 10, and can be seen through the opening 114 in the left major wall portion 11*a*.

As illustrated, the connection between the right and left casing walls 12,11 can be easily separated from each other by rotating the cap member 30 to release the engagement of the retaining recesses 33 and the retaining protrusions 221, and by rotating the nut member 20 for removal from the tubular stem, thereby conveniently replacing the decorating member 50.

Figure 3:
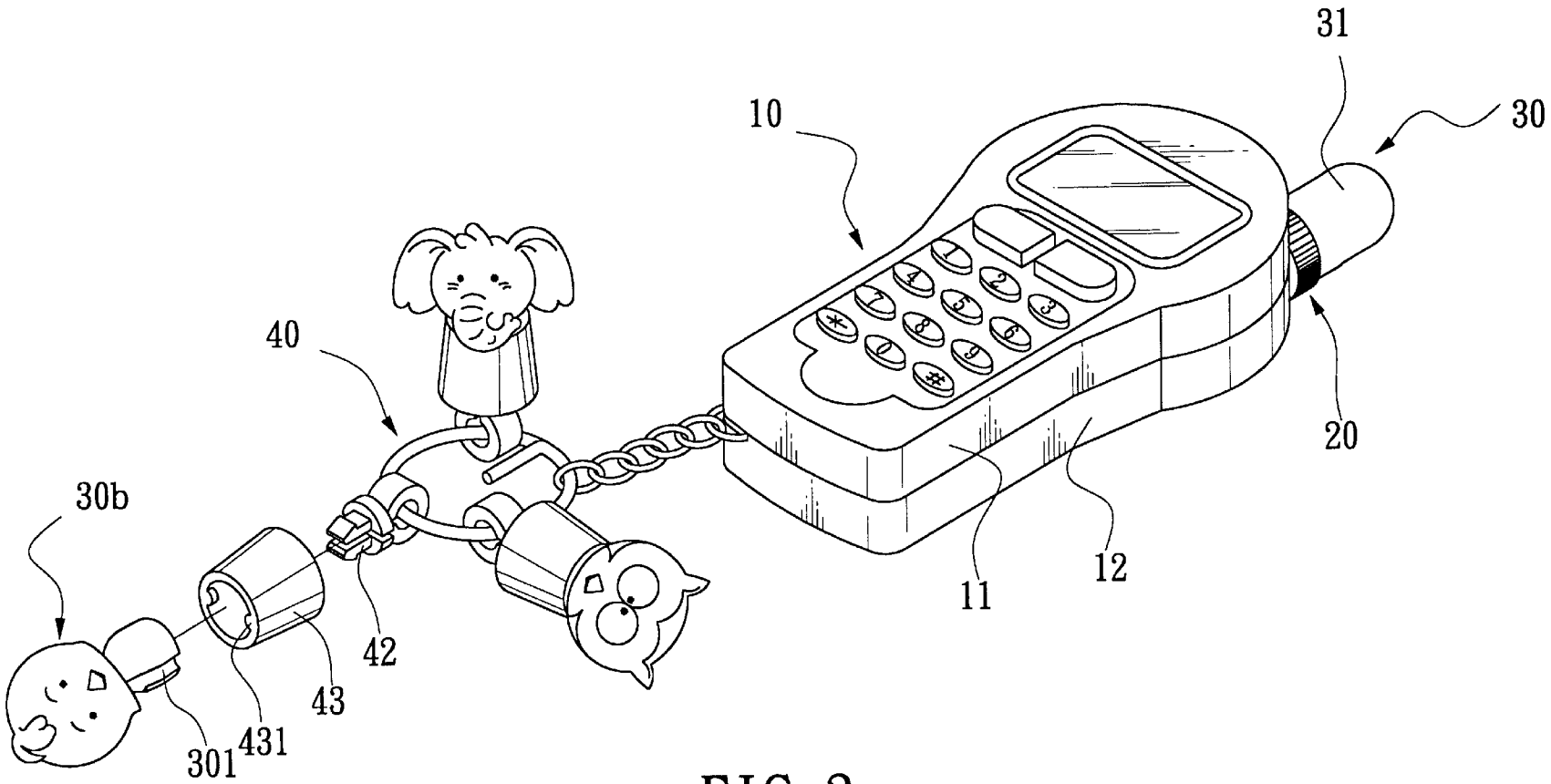
FIG. 3 is a perspective view of the preferred embodiment.
Figure 4:
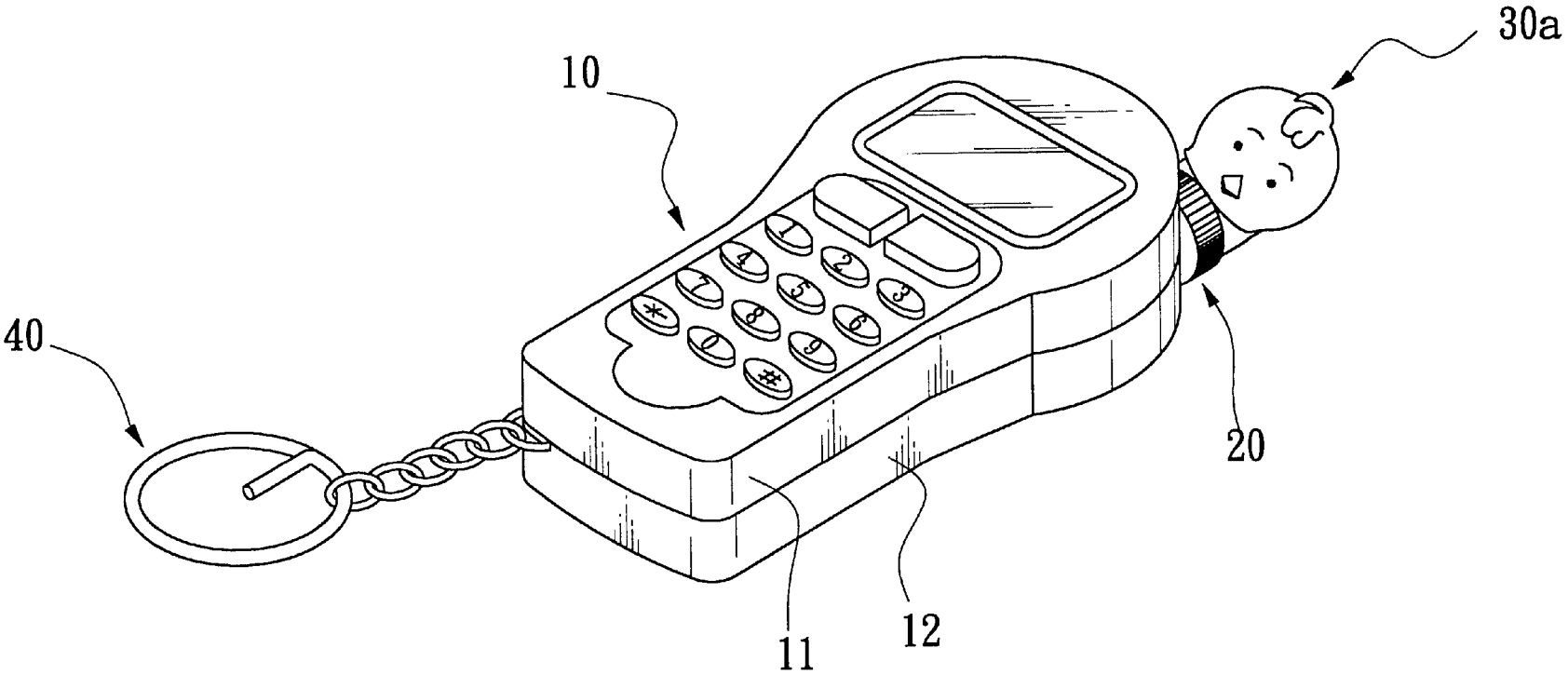
FIG. 4 is a perspective view of the preferred embodiment in another state.

In addition, referring to FIG. 4, instead of the cap member 30 shown in FIGS. 1 and 2, another cap member 30*a* with a doll shape is mounted on the nut member 20 for varying the appearance of the key ring. Moreover, referring to FIG. 3, a plurality of engaging members 42 can be secured on the ring member 40 at first ends thereof, and have engaging protrusions 42 at second ends thereof. A plurality of engaging sleeves 43 are sleeved on the engaging protrusions 42, respectively. Each engaging sleeve 43 has two connecting protrusions 431 which project inwardly and radially from an annular inner peripheral wall thereof. A plurality of decorating members 30*b* have connecting end portions, each of which has two connecting grooves 301 for respectively engaging the connecting protrusions 431 so as to secure the decorating members 30*b* on the ring member 40.

While the present invention has been described in connection with what is considered the most practical and preferred embodiment, it is understood that this invention is not limited to the disclosed embodiment but is intended to cover various arrangements included within the spirit and scope of the broadest interpretations and equivalent arrangements.

I claim:

1. A key ring, comprising:

a casing including complementary right and left casing walls, said right casing wall having a right major wall portion extending in a first direction, a right surrounding wall portion extending from a periphery of said right major wall portion in a second direction transverse to said first direction, and a right stem half protruding from said right surrounding wall portion in said first direction and having a semi-circular right outer threaded surface thereon, said left casing wall having a left major wall portion extending in said first direction, a left surrounding wall portion extending from a periphery of said left major wall portion opposite to said second direction and complementarily mating with said right surrounding wall portion so as to define a receiving chamber between said right and left casing walls, and a left stem half protruding from said left surrounding wall portion in said first direction and having a semi-circular left outer threaded surface thereon so as to cooperate with said right outer threaded surface to form a tubular stem with a spirally winding continuous threaded line thereon surrounding an axis which is parallel to said first direction when said left casing wall is brought along said second direction to mate with said right casing wall; a nut member having an inner peripheral wall with a proximate end portion and a distal end portion opposite to said proximate end portion in said first direction, said proximate end portion having an internal threaded surface to screw on and engage said tubular stem so as to clamp said right and left stem halves together, thereby joining said left casing wall with said right casing wall, said distal end portion having a retaining protrusion projecting inwardly and radially from said inner peripheral wall;

a cap member having an enlarged head portion, and an engaging end portion with an annular surrounding wall which has an elongated guiding groove formed inwardly and radially of said surrounding wall, said guiding groove extending along said axis and having a lead end distal to said enlarged head portion and a tail end proximate to said enlarged head portion so as to receive and guide said retaining protrusion when said engaging end portion is brought to be inserted into said distal end portion of said nut member along said first direction from said lead end, said annular surrounding wall further having a retaining recess formed therein, disposed between said enlarged head portion and said engaging end portion, and extending angularly about said axis such that said retaining protrusion will be able to rotate relative to said cap member about said axis so as to be retained in said retaining recess once said retaining protrusion is brought to move along said guiding groove and beyond said tail end to slip into said retaining recess; and a ring member secured to said casing and adapted for fastening keys thereon.

2. The key ring as claimed in claim 1, further comprising a decorating member received in said receiving chamber, said left major wall portion having an opening so as to permit said decorating member to be visible therefrom.

3. The key ring as claimed in claim 1, further comprising plug and socket joining members respectively disposed between said right and left surrounding wall portions to strengthen connection of said left casing wall with said right casing wall.

4. The key ring as claimed in claim 1, further comprising a hanger disposed on said right major wall portion and having a finger portion that extends parallel to and spaced apart from said right major wall portion and that is adapted to hook on a support.

5. The key ring as claimed in claim 1, wherein said nut member has a surrounding wall with serrations to facilitate gripping thereof.

* * * * *